US009085129B2

(12) United States Patent
Gullentops

(10) Patent No.: US 9,085,129 B2
(45) Date of Patent: Jul. 21, 2015

(54) SYSTEM AND METHOD FOR DIGITAL CREATION OF A PRINT MASTER USING A MULTIPLE PRINTHEAD UNIT

(75) Inventor: Chris Gullentops, Kessel-Lo (BE)

(73) Assignee: Aqfa Graphics NV, Mortsel (BE)

( * ) Notice: Subject to any disclaimer, the term of this patent is extended or adjusted under 35 U.S.C. 154(b) by 0 days.

(21) Appl. No.: 13/816,384

(22) PCT Filed: Aug. 5, 2011

(86) PCT No.: PCT/EP2011/063549
§ 371 (c)(1),
(2), (4) Date: Feb. 11, 2013

(87) PCT Pub. No.: WO2012/022636
PCT Pub. Date: Feb. 23, 2012

(65) Prior Publication Data

US 2013/0141488 A1 Jun. 6, 2013

Related U.S. Application Data

(60) Provisional application No. 61/375,248, filed on Aug. 20, 2010.

(30) Foreign Application Priority Data

Aug. 20, 2010 (EP) ..... 10173533

(51) Int. Cl.
*B41J 2/015* (2006.01)
*B41J 29/38* (2006.01)
(Continued)

(52) U.S. Cl.
CPC ..... *B41C 1/003* (2013.01); *B41J 3/407* (2013.01); *B41C 1/05* (2013.01); *B41C 1/1066* (2013.01); *B41C 1/1075* (2013.01); *B41C 1/18* (2013.01)

(58) Field of Classification Search
CPC ..... B41J 1/54; B41J 2025/008; B41J 1/50; B41J 2202/15; B41J 2002/14435; B41J 2/2135; B41J 2/04505
USPC ..... 347/9, 12, 20, 47, 171, 224
See application file for complete search history.

(56) References Cited

U.S. PATENT DOCUMENTS 4,992,890 A 2/1991 Pinard et al.
5,847,722 A * 12/1998 Hackleman ..... 347/19
(Continued)

FOREIGN PATENT DOCUMENTS

EP 1 428 666 A1 6/2004
EP 2 199 065 A1 6/2010
(Continued)

OTHER PUBLICATIONS

Official Communication issued in International Patent Application No. PCT/EP2011/063549, mailed on Oct. 21, 2011.
(Continued)

*Primary Examiner* — Matthew Luu
*Assistant Examiner* — Partick King
(74) *Attorney, Agent, or Firm* — Keating & Bennett, LLP

(57) ABSTRACT

A relief print master is created by a printhead that jets droplets of a polymerisable liquid on a cylindrical sleeve. The droplets follow a spiral path on the cylindrical sleeve. In a multiple printhead unit, there are different spiral paths associated with the different constituting printheads. The distance between these spiral paths is not even in a prior art system. By rotating the printhead under a specific angle, the distance between these spiral paths becomes even. The invention can also be used for the creation of other types of print plates, such as for example offset print plates.

16 Claims, 7 Drawing Sheets

(51) Int. Cl.

| | |
|---|---|
| ***B41C 1/00*** | (2006.01) |
| ***B41J 3/407*** | (2006.01) |
| *B41C 1/05* | (2006.01) |
| *B41C 1/10* | (2006.01) |
| *B41C 1/18* | (2006.01) |

(56) References Cited

U.S. PATENT DOCUMENTS

| | | | | |
|---|---|---|---|---|
| 6,003,969 | A * | 12/1999 | Freret, Jr. | 347/40 |
| 6,193,923 | B1 | 2/2001 | Leyden et al. | |
| 7,726,765 | B2 * | 6/2010 | Yoshida et al. | 347/19 |
| 2001/0017085 | A1 * | 8/2001 | Kubo et al. | 101/35 |
| 2002/0109741 | A1 * | 8/2002 | Okabe et al. | 347/14 |
| 2003/0189617 | A1 * | 10/2003 | Mott et al. | 347/19 |
| 2004/0131778 | A1 | 7/2004 | Verhoest et al. | |
| 2004/0252174 | A1 | 12/2004 | Baxter et al. | |
| 2005/0046651 | A1 * | 3/2005 | Askren et al. | 347/12 |
| 2005/0179710 | A1 * | 8/2005 | Tatsuta et al. | 347/5 |
| 2006/0238565 | A1 * | 10/2006 | Jung et al. | 347/37 |
| 2007/0197119 | A1 * | 8/2007 | Iwata | 445/24 |
| 2008/0024586 | A1 * | 1/2008 | Barron | 347/225 |
| 2009/0197013 | A1 | 8/2009 | Gouch et al. | |
| 2010/0072181 | A1 | 3/2010 | Maschera et al. | |
| 2010/0149236 | A1 * | 6/2010 | Nishida et al. | 347/9 |
| 2010/0245455 | A1 * | 9/2010 | Mizes et al. | 101/35 |

FOREIGN PATENT DOCUMENTS

| | | | |
|---|---|---|---|
| EP | 2 199 066 | A1 | 6/2010 |
| WO | 2012/080058 | A1 | 6/2012 |

OTHER PUBLICATIONS

Gullentops, "System and method for Digital creation of a print master using a multiple printhead unit", U.S. Appl. No. 13/581.691, filed Aug. 29, 2012.

Gullentops, "Digital System for creating a flexographic printmaster", U.S. Appl. No. 13/816,379, filed Feb. 11, 2013.

Gullentops, "System and method for the digital creation of a print master by means of a liquid droplet deposition apparatus", U.S. Appl. No. 13/883,622, filed May 6, 2013.

* cited by examiner

SYSTEM AND METHOD FOR DIGITAL CREATION OF A PRINT MASTER USING A MULTIPLE PRINTHEAD UNIT

CROSS-REFERENCE TO RELATED APPLICATIONS

This application is a 371 National Stage Application of PCT/EP2011/063549, filed Aug. 5, 2011. This application claims the benefit of U.S. Provisional Application No. 61/375,248, filed Aug. 20, 2010, which is incorporated by reference herein in its entirety. In addition, this application claims the benefit of European Application No. 10173533.0, filed Aug. 20, 2010, which is also incorporated by reference herein in its entirety.

BACKGROUND OF THE INVENTION

1. Field of the Invention

The invention deals with the field of creating print masters, and more specifically with digital methods and systems for creating a digital flexographic print master on a drum by a fluid depositing printhead.

The invention reduces a problem that may result when a printhead unit is used that comprises more than one nozzle row.

2. Description of the Related Art

In flexographic printing or flexography a flexible cylindrical relief print master is used for transferring a fast drying ink from an anilox roller to a printable substrate. The print master can be a flexible plate that is mounted on a cylinder, or it can be a cylindrical sleeve.

The raised portions of the relief print master define the image features that are to be printed.

Because the flexographic print master has elastic properties, the process is particularly suitable for printing on a wide range of printable substrates including for example, corrugated fiberboard, plastic films, or even metal sheets.

A traditional method for creating a print master uses a light sensitive polymerisable sheet that is exposed by a UV radiation source through a negative film or a negative mask layer ("LAMS"-system) that defines the image features. Under the influence of the UV radiation, the sheet will polymerize underneath the transparent portions of the film. The remaining portions are removed, and what remains is a positive relief printing plate.

In the unpublished applications EP08172281.1 and EP08172280.3, both assigned to Agfa Graphics NV and having a priority date of 2008-12-19, a digital solution is presented for creating a relief print master using a fluid droplet depositing printhead.

The application EP08172280.3 teaches that a relief print master can be digitally represented by a stack of two-dimensional layers and discloses a method for calculating these two-dimensional layers.

The application EP08172281.1 teaches a method for spatially diffusing nozzle related artifacts in the three dimensions of the stack of two-dimensional layers.

Both applications also teach a composition of a fluid that can be used for printing a relief print master, and a method and apparatus for printing such a relief print master.

FIG. 1 shows an embodiment of such an apparatus 100. 140 is a rotating drum that is driven by a motor 110. A printhead 160 moves in a slow scan direction Y parallel with the axis of the drum at a linear velocity that is coupled to the rotational speed X of the drum. The printhead jets droplets of a polymerisable fluid onto a removable sleeve 130 that is mounted on the drum 140. These droplets are gradually cured by a curing source 150 that moves along with the printhead and provides local curing. When the relief print master 130 has been printed, the curing source 170 provides an optional and final curing step that determines the final physical characteristics of the relief print master 120.

An example of a printhead is shown in FIG. 3. The printhead 300 has nozzles 310 that are arranged on a single axis 320 and that have a periodic nozzle pitch 330. The orifices of the nozzles are located in a nozzle plate that is substantially planar.

FIG. 2 demonstrates that, as the printhead moves from left to right in the direction Y, droplets 250 are jetted onto the sleeve 240, whereby the "leading" part 211 of the printhead 210 prints droplets that belong to a lower layer 220, whereas the "trailing" part 212 of the printhead 210 prints droplets of an upper layer 230.

Because in the apparatus in FIGS. 1 and 2 the linear velocity of the printhead in the direction Y is locked with the rotational speed X of the cylindrical sleeve 130, 240, each nozzle of the printhead jets fluid along a spiral path on the rotating drum. This is illustrated in FIG. 5, where it is shown that fluid droplets ejected by nozzle 1 describe a spiral path 520 that has a pitch 510.

In FIG. 5, the pitch 510 of the spiral path 520 was selected to be exactly double the length of the nozzle pitch 530 of the printhead 540. The effect of this is that all the droplets of nozzles 1, 3, 5 having an odd index number fall on the first spiral path 520, whereas the droplets ejected by nozzles 2, 4, 6 having an even index number fall on the second spiral path 550. Both spiral paths 520, 550 are interlaced and spaced at an even distance 560 that corresponds with the nozzle pitch 530.

The lowest value of the nozzle pitch 330 in FIG. 3 is constrained by technical limitations in the production of a printhead. One solution to overcome this constraint is to use a multiple printhead unit.

The concept of a multiple printhead unit is explained by means of FIG. 4. As the figure shows, two printheads 401 and 402 are mounted to form a multiple printhead unit 400. The nozzle rows 420 and 421 are substantially parallel. By staggering the position of the nozzles 410 on the axis 420 of head 401 and the nozzles 411 on axis 421 of printhead 402 over a distance of half a nozzle pitch, the effective nozzle pitch 431 of the multiple printhead unit is half the nozzle pitch of each constituting printhead 401, 402 and the effective printing resolution is doubled.

The use of a multiple printhead unit in an apparatus as shown in FIG. 1 or FIG. 2 for the purpose of printing a relief print master introduces an unexpected and undesirable side effect.

FIG. 6. shows a first spiral path 610 on which fluid droplets from the nozzles having an odd index number 1, 3 and 5 land and a second spiral path 611 on which the fluid droplets of the nozzles having an even index number 2, 4 and 6 land.

The nozzles with an odd index number are located on a first axis 620 and the nozzles having an even index number are located on a second axis 621, parallel with the first axis 620.

Because these two axes 620 and 621 of the nozzle rows in the multiple printhead unit are not congruent, the spiral paths 610 and 611 are not evenly spaced with regard to each other. For example, in FIG. 6 the distance 640 is different from the distance 641.

The uneven spacing of the spiral paths 610 and 611 causes an uneven distribution of the fluid droplets along the Y direction when they are jetted onto the sleeve and this negatively affects the quality of the print master that is printed.

SUMMARY OF THE INVENTION

In order to overcome the problems described above, preferred embodiments of the current invention improve the evenness of the distribution of the spiral paths on which the fluid droplets are jetted by a printhead unit that comprises multiple printheads.

Preferred embodiments of the current invention are realized by a system and a method as described below.

By rotating the multiple printhead unit in the plane that is perpendicular with the jetting direction of the nozzles, the unevenness of the distances between the interlaced spiral paths can be reduced or even eliminated.

Various preferred embodiments are also described below.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 6:
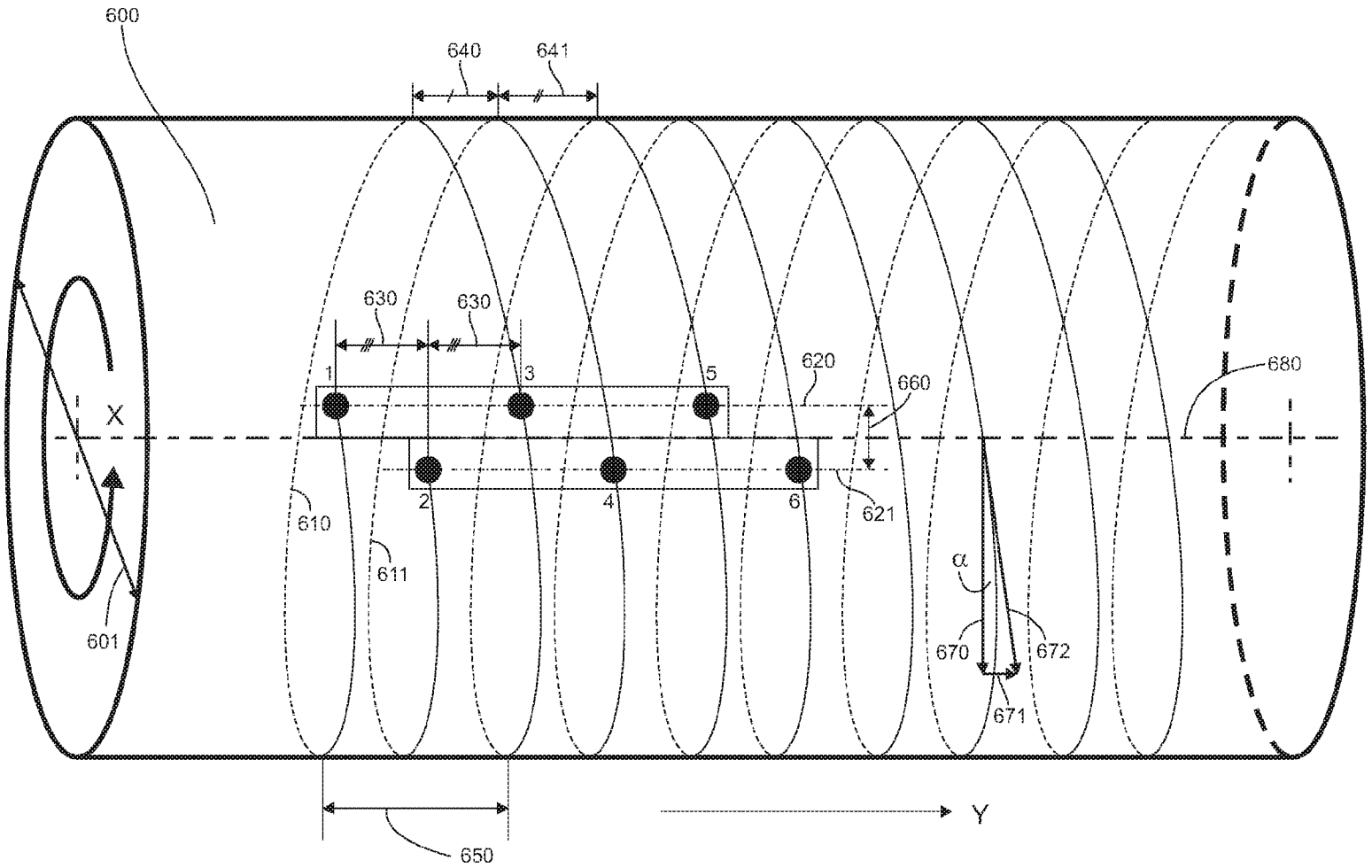
FIG. 6 PRIOR ART
FIG. 6 shows two spiral paths on which the fluid droplets land that are ejected by the nozzles of a multiple printhead unit as the one shown in FIG. 4.

In FIG. 6 a rotating sleeve 600 or support that has a diameter 601 is represented by the variable SleeveDiameter.

The circumference of the sleeve is represented by the variable SleeveCircumference and has a value equal to:

$$\text{SleeveCircumference}=PI*\text{SleeveDiameter}$$

The sleeve rotates in the X direction at a frequency that is represented by the variable NumberofRevolutionsperSecond. The direction and magnitude of this rotation with regard to the printhead defines a first speed vector 670 that is tangential to the cylindrical sleeve and perpendicular to its central axis.

The time of one revolution is represented by the variable RevolutionPeriod. It is equal to:

$$\text{RevolutionPeriod}=1/\text{NumberofRevolutionsperSecond}.$$

The circumferential speed of the sleeve has a value represented by the variable CircumferentialSpeed and is equal to:

$$\text{CircumferentialSpeed}=\text{SleeveCircumference}*\text{NumberofRevolutionsperSecond}$$

The distance between two adjacent nozzles along the Y-dimension in the multiple printhead unit in FIG. 6 is the nozzle pitch 630 and is represented by a variable P.

The movement of the printhead in the Y direction is locked to the rotation of the sleeve by a mechanical coupling (for example a worm and gear) or by an electronic gear (electronically coupled servomotors). During a single revolution of the sleeve, the printhead moves over a distance 650 that is represented by a variable PrintheadPitch. The value of this distance 650 should be an integer multiple of the nozzle pitch 630 and this multiple is represented by a variable IntegerMultiplier:

$$\text{PrintheadPitch}=\text{IntegerMultiplier}*P$$

In FIG. 6 the value of IntegerMultiplier is equal to 2.

The speed at which the printhead moves in the Y direction is represented by the variable PrintheadSpeed. Its value is equal to:

$$\text{PrintheadSpeed}=\text{PrintheadPitch}/\text{RevolutionPeriod}$$

The speed and magnitude of the printhead defines a second speed vector 671.

The sum of the first speed vector 670 and the second speed vector 671 defines a third speed vector 672. This speed vector 672 is tangential to the spiral path on which the liquid droplets are jetted. The angle α between the first speed vector 670 and the sum 672 of the first and second speed vectors is expressed by the following formulas:

$$\tan(\alpha)=\text{PrintheadSpeed}/\text{CircumferentialSpeed}$$

$$\alpha=a\tan(\text{PrintheadSpeed}/\text{CircumferentialSpeed})$$

The distance 660 between the two nozzle rows 620 and 621 in FIG. 6 is represented by the variable D.

Figure 5:
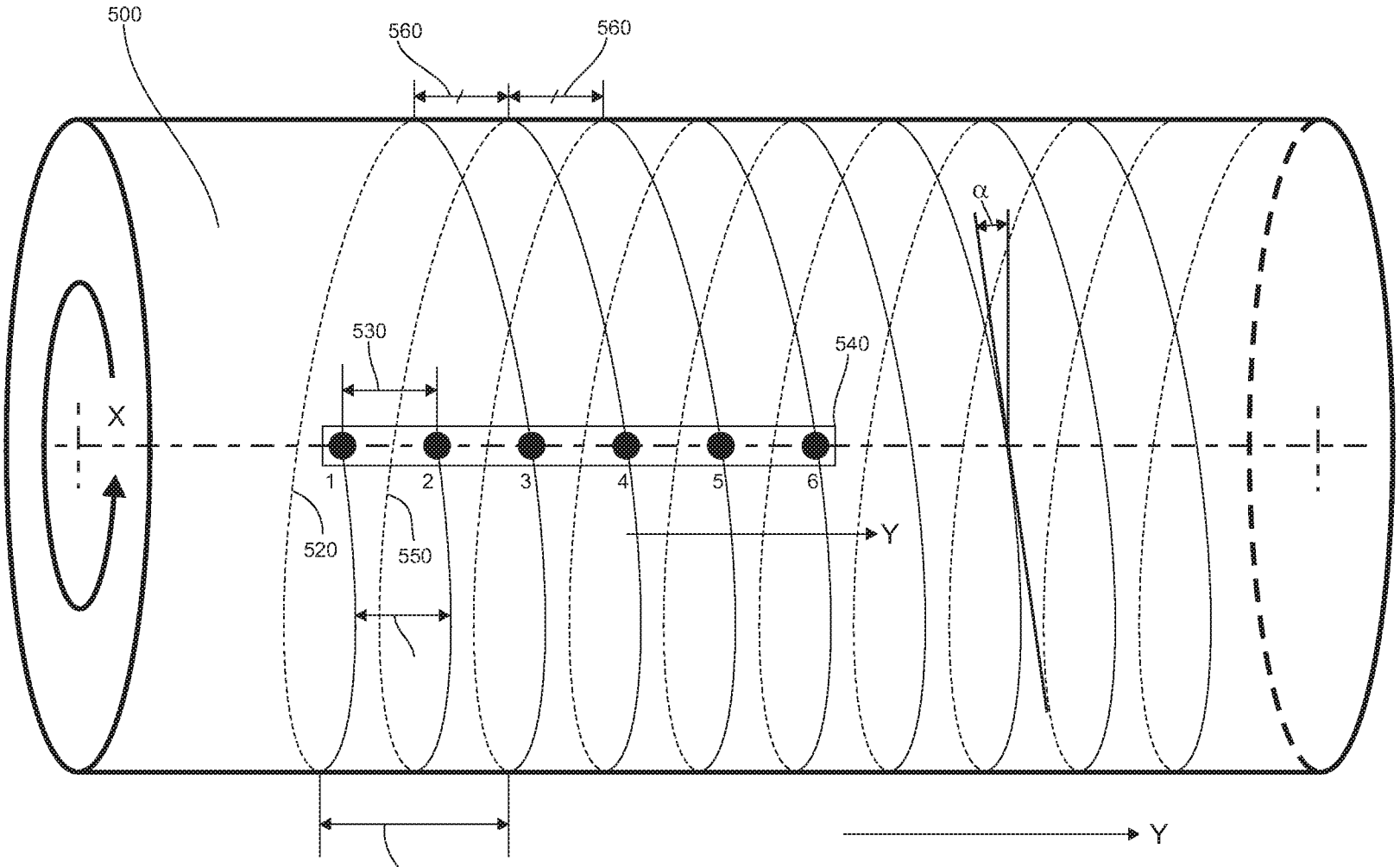
FIG. 5 PRIOR ART
FIG. 5 shows two spiral paths on which the fluid droplets ejected by the nozzles of a printhead as in FIG. 3 land.

Unlike in the case shown in FIG. 5 where a printhead has only one row of nozzles, the two spiral paths 610, 611 in FIG. 6 on which droplets land that are ejected from two different nozzle rows are not evenly spaced along the Y direction. More specifically, the distance 640 in FIG. 6 is shorter than the distance 641. This effect is the result of the distance D 660 between the two nozzle rows 620, 621.

Figure 7:
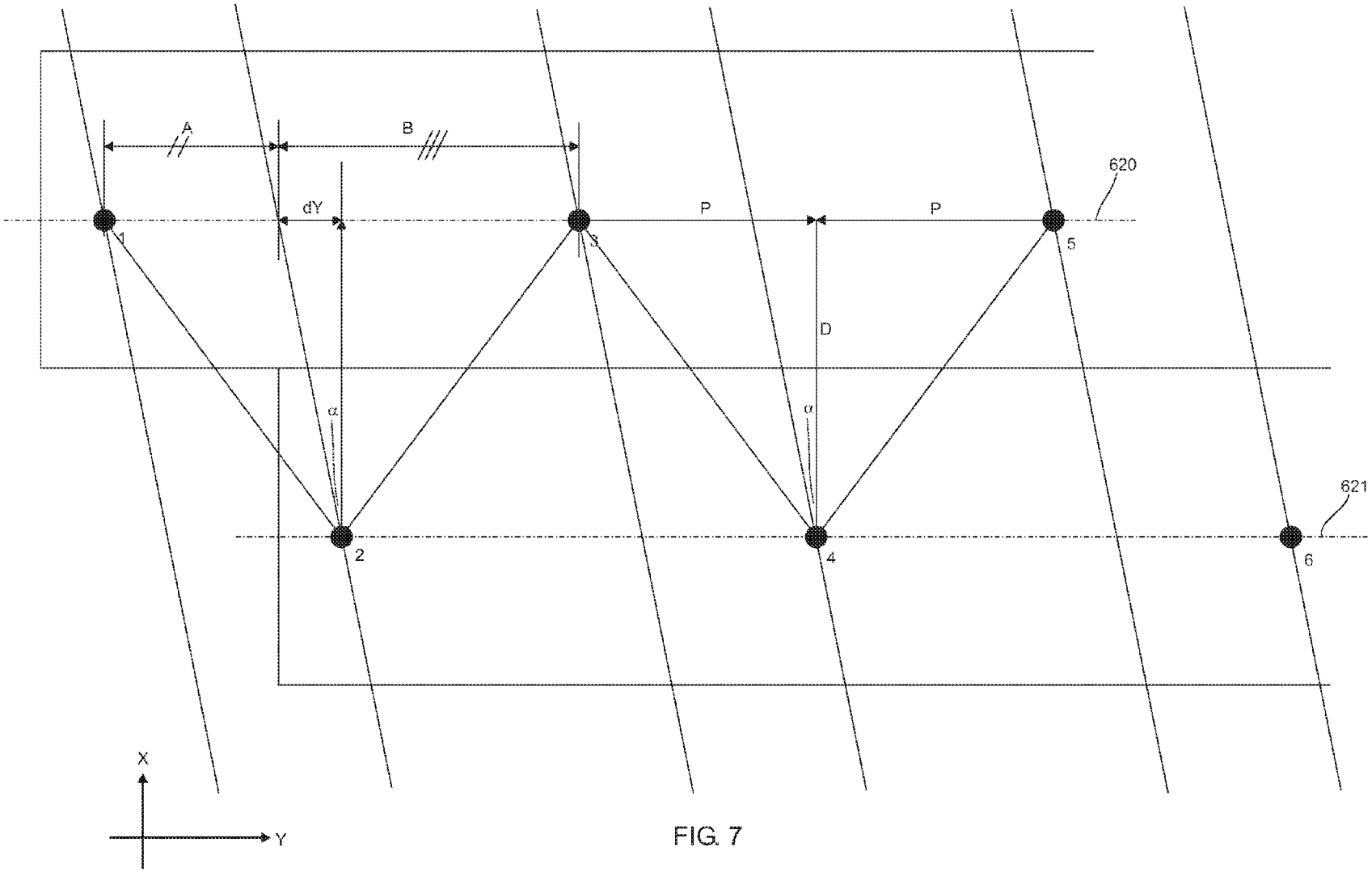
FIG. 7 describes in detail the geometrical interactions between the movements of the printhead and the cylindrical sleeve, and the distance between the spiral paths when the nozzle rows of the printhead are parallel with the axis of the cylindrical sleeve.

FIG. 7 shows a detail of FIG. 6 that is used for geometrically describing the difference between the distance 640 and the distance 641 in FIG. 6.

In the analysis that follows, it is assumed that the length of the distance D is negligible with regard to the length of the Circumference. In that case the cylindrical surface of the sleeve can be locally approximated by a plane so that conventional (two-dimensional) trigonometry can be used to describe the geometrical relationships between the different variables.

In FIG. 7:

- the distance P corresponds with the nozzle pitch 630 in FIG. 6;
- the distance D corresponds with the distance 660 between two nozzle rows in FIG. 6;
- the distance A corresponds with the distance 640 between two spiral paths in FIG. 6;
- the distance B corresponds with the distance 641 between two spiral paths in FIG. 6.

The distance dY corresponds with the amount that the distance A is shorter than the nozzle pitch P, and the amount that the distance B is longer than the distance P. This is mathematically expressed as follows:

$$A=P-dY$$

$$B=P+dY$$

$$A+B=2*P$$

The value of dY can be directly expressed as a function the angle α and the nozzle row distance D:

$$\tan(\alpha)=dY/D$$

$$dY=D*\tan(\alpha)$$

And hence:

$$A=P-D*\tan(\alpha)$$

The above expression teaches that:

$$A=P$$

under the following two conditions:

1. D=0 (this is essentially the situation that is shown in FIG. 5)
2. α=0 (this situation is only approximated when the PrintheadPitch is very small with respect to the CircumferentialSpeed, which is the case in many practical situations)

The above expression also teaches that dY becomes larger when the distance D between the nozzle rows increases or when the ratio of the PrintheadSpeed over the CircumferentialSpeed increases.

Figure 8:
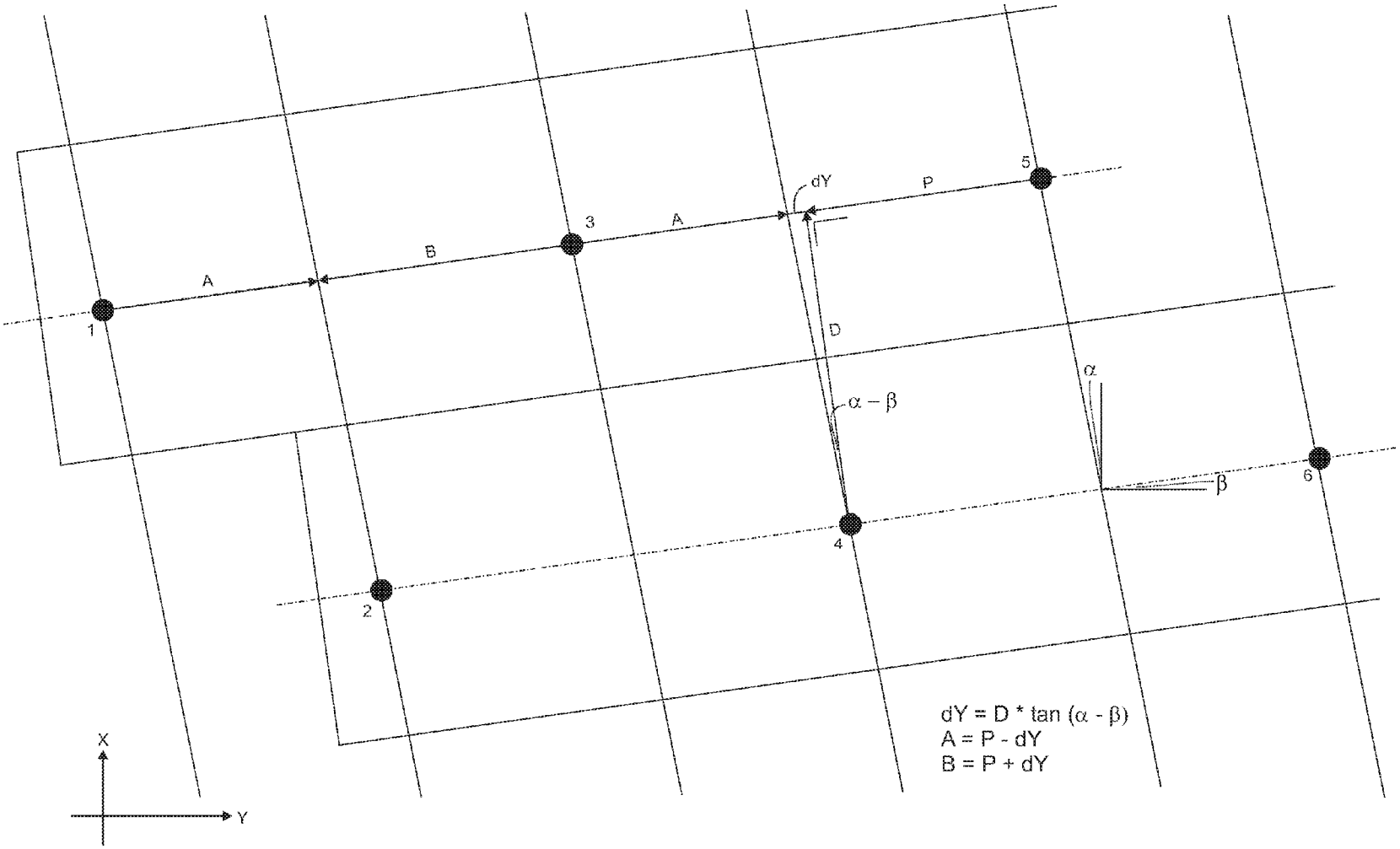
FIG. 8 describes in detail the geometrical interactions between the movements of the printhead and the cylindrical sleeve, and the distance between the spiral paths when the nozzle rows of the printhead are rotated in a plane that is orthogonal to the jetting direction of the nozzles.

We will now describe by means of FIG. 8 that it is possible to reduce dY, or even to make dY equal to zero and hence to make:

$$A=B=P$$

without setting α=0 or setting D=0, but instead by rotating the printhead in a plane that is orthogonal to the jetting direction of the nozzles and under a specific angle β. Such a plane is parallel with the In FIG. 8, the following expression is derived for dY:

$$\tan(\alpha-\beta)=dY/D$$

$$dY=D*a\tan(\alpha-\beta)$$

By setting:

$$\beta=\alpha$$

it is obtained that:

$$A=P=B$$

In other words, by rotating the printhead over an angle β in a plane that is orthogonal to the jetting direction of the nozzles, whereby the angle β is equal to the angle α, it is obtained that these interlaced paths become equidistant and become spaced at a distance equal to the nozzle pitch.

Figure 9:
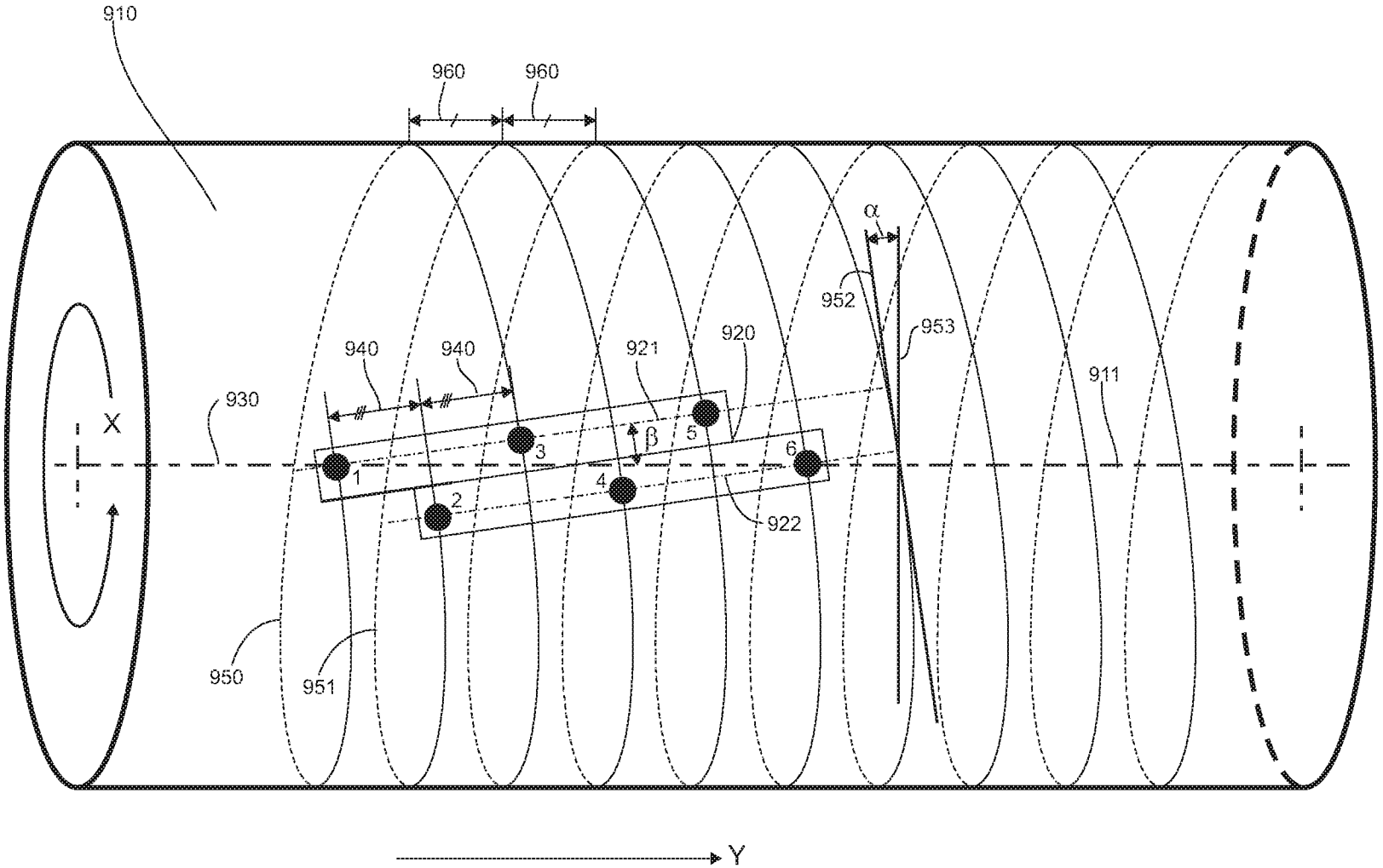
FIG. 9 shows a preferred embodiment according to the current invention in which the nozzle rows are rotated so that the distances between the spiral paths on which the nozzles eject droplets becomes more even.

FIG. 9 gives a further illustration of a preferred embodiment of the current invention. By rotating the printhead under an angle β in the plane defined by the two nozzle rows, whereby the angle β corresponds with the angle α, it is possible to equalize the distance 960 between the spiral paths 950 and 951 and to make them equal to the nozzle pitch 940.

The above description provides an exemplary preferred embodiment of the current invention on which a number of variations exist.

In the first place it is not required that the value of IntegerMultiplier is equal to 2 as in FIG. 5, 6 or 9. In principle any integer number N can be used such as 2, 3, 4 or more. From the above explanation it should be clear to a person skilled in the art that a value of N for the variable IntegerMultiplier will also result in N interleaved spiral paths.

In the second place it is not always required that the angle α and angle β are exactly equal to each other. It was already demonstrated by means of FIG. 7 that if the distance D between the nozzle rows is small compared to the circumference of the cylindrical sleeve, that the deviation dY is small compared to the distance P of the nozzle pitch. In that case a rotation β of the printhead that is less than a provides already a sufficient improvement of the evenness of the distances A and B between the spiral paths.

Preferably:

$$|\alpha-\beta|<0.5*|\alpha|$$

Even more preferably $$|\alpha-\beta|<0.1*|\alpha|$$

And even more preferably:

$$|\alpha-\beta|<0.01*|\alpha|$$

In the third place, preferred embodiments of the invention are not limited to a multiple printhead unit that comprises only two rows of nozzles. The number of rows of nozzles can, in principle, be any integer number M (such as 2, 3, 4 or more). In the case that more than two nozzle rows are present, the rotation of each one of the constituting printheads takes preferably place in a plane that is orthogonal to the direction in which the droplets are ejected by each printhead.

Whereas preferred embodiments of the invention have been described in the context of an apparatus for creating a flexographic print master using a printhead that comprises fluid ejecting nozzles, it can just as well be used for other external drum based recording systems that use parallel rows of marking elements.

A first example of an alternative recording system is a laser imaging system that uses a laserhead with rows of laser elements as marking elements.

A second example of an alternative recording system uses a spatial light modulator with rows of light valves as marking elements. Examples of spatial light modulators are digital micro mirror devices, grating light valves and liquid crystal devices.

All these systems can be used for creating a print master. For example, a laser based marking system, a light valve marking system or a digital micro mirror device marking system can be used to expose an offset print master precursor.

Figure 2:
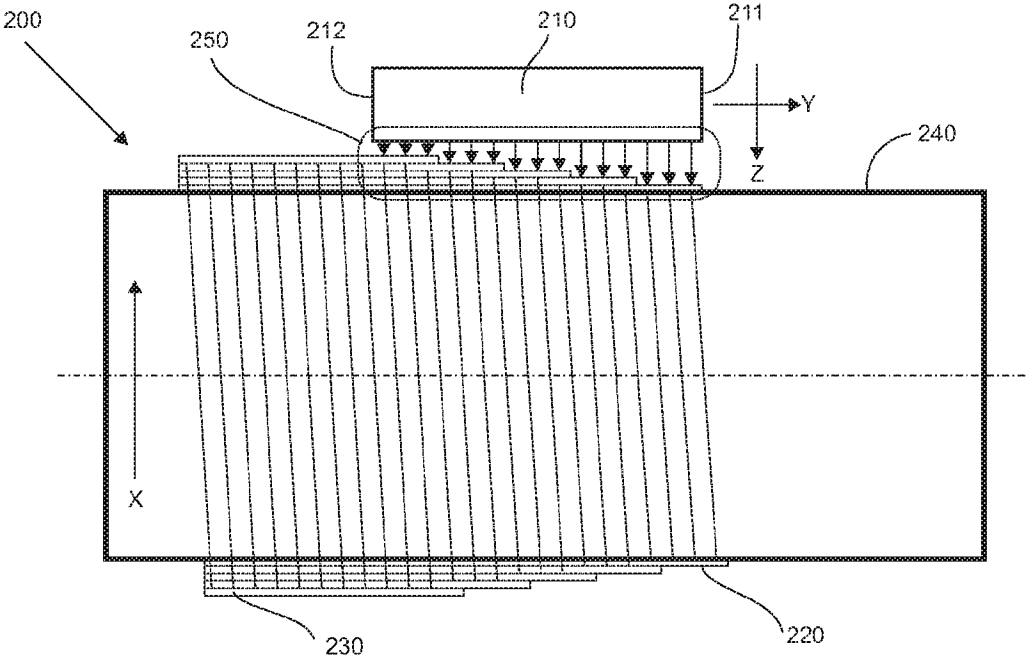
FIG. 2 Prior Art
FIG. 2 shows a different view of an embodiment of an apparatus for printing a relief print master on a sleeve.
Figure 1:
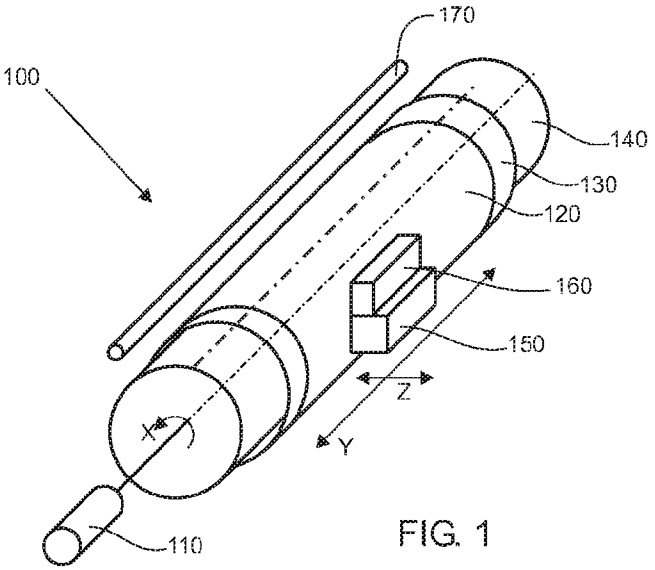
FIG. 1 Prior Art
FIG. 1 shows an embodiment of an apparatus for printing a relief print master on a sleeve.
Figure 4:
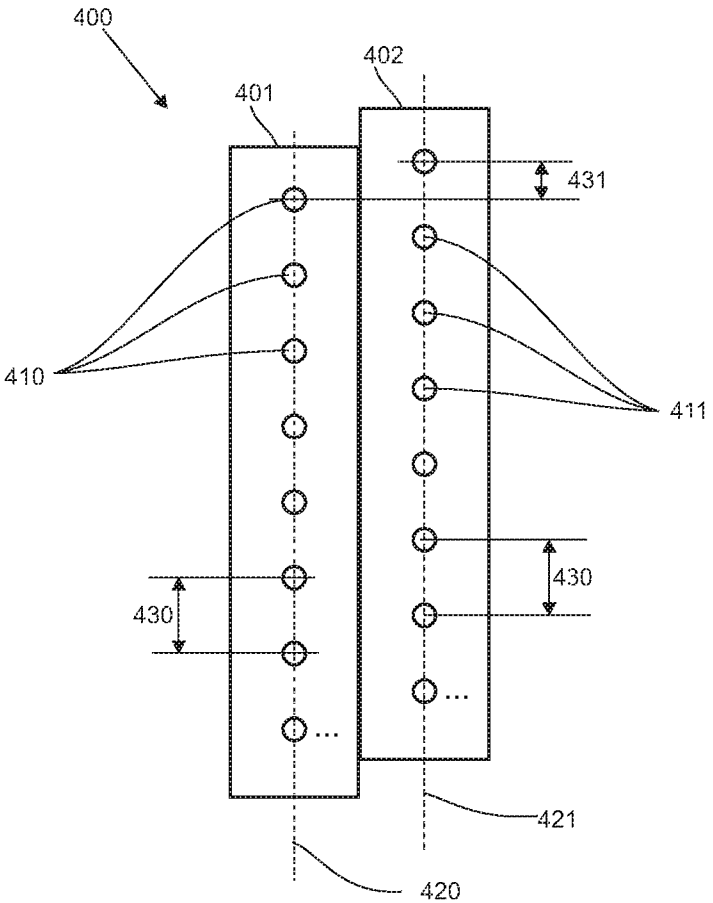
FIG. 4 shows a multiple printhead unit with two rows of nozzles.
Figure 3:
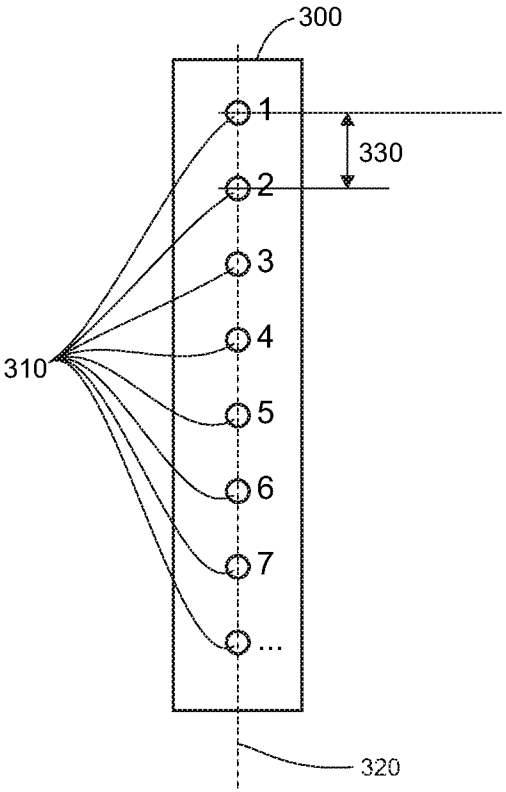
FIG. 3 shows a printhead with a single row of nozzles.

Preferred embodiments of the invention are advantageously used for creating a relief print master by building up the relief layer by layer using a system such as the one that is shown in FIG. 1 or FIG. 2. A relief print master, however, can also be obtained for example using one of the following preferred embodiments.

In a first preferred embodiment an imaging system according to the current invention is used for imagewise exposing a mask so that that it comprises transparent and non-transparent portions. The mask is than put on top of a flexible, photopolymerizable layer and exposed by a curing source. The areas that exposed through transparent portions of the mask harden out and define the features of the print master that are in relief. The unexposed areas are removed and define the recessed portions of the relief print master.

In a second preferred embodiment, the imaging system according to a preferred embodiment of the current invention selectively exposes a flexible, elastomeric layer, whereby the energy of the exposure directly removes material from the flexible layer upon impingement. In this case the unexposed areas of the flexible layer define the relief features of the print master.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

The invention claimed is:

1. A system for preparing a print master with a marking engine, the system comprising:

a cylindrical support having a central axis; and a marking head unit to mark at least one layer of marks on the cylindrical support; wherein the cylindrical support is arranged to rotate around the central axis relative to the marking head unit at a first speed, a rotation of the cylindrical support including a first speed vector that is tangential to the cylindrical support;

the marking head unit is arranged to move along a slow scan direction parallel or substantially parallel with the central axis at a second speed that is locked to the first speed, a movement of the marking head unit including a second speed vector that is in a same plane as the first speed vector;

an angle between the first speed vector and a sum of the first speed vector and the second speed vector has a value $\alpha$;

the marking head unit includes at least two parallel or substantially parallel rows of marking elements that create marks along interlaced spiral paths around the central axis, a distance between the at least two parallel or substantially parallel rows of marking elements introduces uneven spacing between the spiral paths;

the at least two parallel or substantially parallel rows of marking elements are rotated by an angle $\beta$ in a plane that is parallel with the first speed vector and the second speed vector, a rotation of the at least two parallel or substantially parallel rows takes place in a direction that is orthogonal with a tangent of the spiral paths so that the uneven spacing between the spiral paths is reduced or eliminated; and $$|\alpha-\beta|<0.5*|\alpha|.$$

2. The system according to claim 1, wherein the marking head unit is an inkjet printhead and the marking elements are inkjet nozzles.

3. The system according to claim 1, wherein the marking head unit is a laserhead and the marking elements are laser elements.

4. The system according to claim 1, wherein the marking head unit is a spatial light modulator and the marking elements are light valves.

5. The system according to claim 4, wherein the marking head unit is a digital mirror device and the marking elements are micro mirrors.

6. The system according to claim 1, wherein $|\alpha-\beta|<0.1*|\alpha|$.

7. The system according to claim 6, wherein $|\alpha-\beta|0.01*|\alpha|$.

8. The system according to claim 1, wherein the print master is a relief printmaster.

9. A method for preparing a print master with a marking engine that includes a marking head unit, the method comprising the steps of:

marking with the marking head unit at least one layer of marks on a cylindrical support, the cylindrical support having a central axis;

rotating the cylindrical support around the central axis relative to the marking head unit at a first speed, a rotation of the cylindrical support defining a first speed vector that is tangential to the cylindrical support; and moving the marking head unit at a second speed in a slow scan direction that is parallel or substantially parallel to the central axis and that is locked to the first speed, a movement of the marking head unit defining a second speed vector that is in a same plane as the first speed vector; wherein an angle between the first speed vector and a sum of the first speed vector and the second speed vector has a value $\alpha$;

the marking head unit includes at least two parallel or substantially parallel rows of marking elements that create marks along interlaced spiral paths around the central axis, a distance between the at least two parallel or substantially parallel rows of marking elements introduces uneven spacing between the spiral paths;

rotating the at least two parallel or substantially parallel rows of the marking elements by an angle $\beta$ in a plane that is parallel with the first and second speed vectors, a rotation of the at least two parallel or substantially parallel rows taking place in a direction that is orthogonal with a tangent of the spiral paths so that the uneven spacing between the spiral paths is reduced or eliminated; and $$|\alpha-\beta|<0.5*|\alpha|.$$

10. The method according to claim 9, wherein the marking head unit is an inkjet printhead and the marking elements are inkjet nozzles.

11. The method according to claim 9, wherein the marking head unit is a laserhead and the marking elements are laser elements.

12. The method according to claim 9, wherein the marking head unit is a spatial light modulator and the marking elements are light valves.

13. The method according to claim 12, wherein the marking head unit is a digital micro mirror device and the marking elements are micro mirrors.

14. The method according to claim 9, wherein $|\alpha-\beta|<0.1*|\alpha|$.

15. The method according to claim 14, wherein $|\alpha-\beta|<0.01*|\alpha|$.

16. The method according to claim 9, wherein the print master is a relief print master.

* * * * *